US007308906B2

(12) United States Patent
Sinclaire

(10) Patent No.: US 7,308,906 B2
(45) Date of Patent: Dec. 18, 2007

(54) MULTI-STORY WATER DISTRIBUTION SYSTEM

(75) Inventor: Ross Sinclaire, 1315 Colborne Crescent S.E., Calgary, Alberta (CA) T2T 0R3

(73) Assignee: Ross Sinclaire, Alberta (CA)

( * ) Notice: Subject to any disclaimer, the term of this patent is extended or adjusted under 35 U.S.C. 154(b) by 375 days.

(21) Appl. No.: 10/851,349

(22) Filed: May 21, 2004

(65) Prior Publication Data

US 2005/0183773 A1 Aug. 25, 2005

Related U.S. Application Data

(60) Provisional application No. 60/559,023, filed on Apr. 5, 2004, provisional application No. 60/546,184, filed on Feb. 23, 2004.

(51) Int. Cl.
*F16L 5/00* (2006.01)

(52) U.S. Cl. ..... 137/357; 137/563

(58) Field of Classification Search ..... 137/563, 137/357, 505, 341; 165/244; 237/8 R, 63
See application file for complete search history.

(56) References Cited

U.S. PATENT DOCUMENTS 3,617,699 A * 11/1971 Othmer ..... 392/469
3,692,047 A * 9/1972 Camp ..... 137/495
5,022,231 A * 6/1991 Martinez, Jr. ..... 62/99
5,032,290 A * 7/1991 Yamagata et al. ..... 210/747
5,183,102 A 2/1993 Clark
5,425,503 A * 6/1995 Corso ..... 237/63
5,540,555 A * 7/1996 Corso et al. ..... 417/44.2
6,125,880 A * 10/2000 Szilagyi ..... 137/340
6,715,691 B2 * 4/2004 Park et al. ..... 237/8 A
2004/0026075 A1 * 2/2004 Park et al ..... 165/218

FOREIGN PATENT DOCUMENTS

CA 2082718 4/1997

* cited by examiner

*Primary Examiner*—Eric Keasel
*Assistant Examiner*—Cloud Lee
(74) *Attorney, Agent, or Firm*—Sheridan Ross P.C.

(57) ABSTRACT

A method and system for the distribution of water in a high rise building is provided using a minimum number of piping risers. The system has a domestic cold water riser, and a domestic hot water supply riser and a return riser. At each serviced floor, a cold water supply main extends from the domestic cold water riser and a hot water supply main extends from the domestic hot water supply riser. On each floor at which riser pressure is higher than domestic use pressures, a valve reduces the pressure of the entire cold water supply main to domestic use pressures. One or more valves at each of one or more suites on the floor reduce the pressure of the hot water to each suite, leaving the hot water supply main for the floor at full riser pressure. Coupling fan-coils with chilled water supply and the full pressure domestic hot water provides an efficient piping system for both environmental controls and domestic hot water use. Regular and periodic circulation through fan-coils avoid stagnation of the domestic hot water supply.

17 Claims, 10 Drawing Sheets

MULTI-STORY WATER DISTRIBUTION SYSTEM

This application claims the benefit of U.S. provisional patent application Ser. No. 60/546,184, filed Feb. 23, 2004, and U.S. provisional patent application Ser. No. 60/559,023, filed Apr. 5, 2004. The entire disclosures of the provisional applications are considered to be part of the disclosure of the accompanying application and are hereby incorporated by reference.

FIELD OF THE INVENTION

The present invention relates to systems for the distribution of water in buildings and to systems that minimize the number of piping risers through the strategic placement of pressure reducing valves.

BACKGROUND OF THE INVENTION

Water distribution systems for multi-story buildings typically comprise various arrangements of water supply and returns. Multi-story buildings introduce challenges including minimizing redundant piping and providing some form of pressure control from floor to floor where hydrostatic head varies, yet pressure for domestic purposes should be relatively constant.

As set forth in U.S. Pat. No. 5,183,102 to Clark, the entirety of which is incorporated herein by reference, an improvement in efficiency in piping runs was suggested using existing sprinkler systems and domestic hot water systems to double as cooling and heating systems. This system avoids piping an independent supply of chilled water through a first dedicated piping system that circulates the chilled water throughout the building and avoids piping an independent heating system and supply of hot water through a separate second dedicated piping system for circulation throughout the building.

Traditionally, room-by-room heating, and air conditioning systems in large buildings have been what are known in the art as four-pipe fan-coil systems; two pipes for cooling water flow, and two for heating water flow. Individual fan-coil units placed at various locations throughout the building provide for zonal temperature control. Heating or cooling is provided by having the fan circulate air over a coil that is accessing either the hot-water or the chilled-water piping system, respectively. As was recognized by Clark, while the four-pipe fan-coil system provides zonal temperature control, economy of operation, low maintenance, and minimum noise, the relatively high cost of constructing the dedicated hot and chilled-water piping systems had reduced their popularity.

Clark utilized a watercooler integrated into the fire sprinkler piping system of a building. The watercooler, along with a chilled-water pump, circulates chilled water throughout the fire sprinkler piping system. In addition, water circulating in the domestic hot-water piping system is accessed for heating purposes.

While Clark discussed implementation to multi-story buildings, there is no solution offered which recognizes variations in hydraulic pressure as water is delivered from the lowest floor to the highest floor, particularly when considering domestic water requirements and the desirability of experiencing consistent water pressure. To date, the Clark system has been applied to low buildings and each floor is supplied with independent risers from the main floor to each higher floor at pressures of about 40 to 74 psig.

In a 24 storey building the pressure at the lowest floor may be about 130 psig so as to maintain 40 psig at the roof where the hydraulic head is at its minimum. To supply a 72 storey building from a single riser would result in pressures at the lowest floor at about 250 psi. However, it is unacceptable to apply 250 psi or even 130 psig water for domestic use. Further, higher pressure in the domestic hot water system will ensure return flow to the boilers but the pressure is too high for domestic purposes.

Shortcomings in the known combination sprinkler and domestic hot water systems have resulted in limited acceptance of the technology even after all of this time. Applicant addresses these shortcomings.

SUMMARY OF THE INVENTION

Applicant has provided a system which significantly reduces the piping needed to supply domestic hot and cold water to one or more units, residences or suites in high rise buildings and solves issues associated with the supply of water at pressures above desired domestic use pressures. The number of risers throughout can be reduced in number by more than an order of magnitude. Noise issues associated with flow in risers extending through each suite is substantially eliminated.

Applicant recognized that several aspects of pressure control at each floor provides significant advantages. Use of pressure reducing valves on domestic water systems eliminates floor to floor risers and remarkably reduces piping runs. Pressure and flow control is maintained despite the number of floors in the building. No longer does domestic water pressure and plumbing fitting requirements limit the use of common risers at full pump pressure at full hydrostatic head. Further, the system has several solutions for avoiding stagnation which can occur in some domestic lines, contrary to public safety and contrary to plumbing regulations in some jurisdictions.

In one embodiment, the system has a domestic cold water riser, and a domestic hot water supply riser and may include a return riser. At each serviced floor, a domestic cold water supply main extends from the cold water riser and a domestic hot water supply main extends from the hot water supply riser. On each floor at which riser pressure is higher than domestic use pressures, a pressure reducing valve reduces the pressure of the entire cold water supply main to domestic use pressures. In cases where there is no domestic hot water return riser, a pressure reducing valve reduces the pressure of the entire hot water supply main to domestic use pressures; this hot water main being heat traced to maintain the temperature of the hot water available for use. In cases where there is a domestic hot water return riser, then one or more pressure reducing valves at each of one or more suites on the floor reduce the pressure of the domestic hot water available at each suite, leaving the domestic hot water supply main for the floor at full riser pressure so that may recirculate into the return riser while also enabling maintaining hot water recirculation or for secondary heating purposes. Coupling fan-coils off of the full riser pressure domestic hot water main provides an efficient piping system for both environmental controls and domestic hot water use. Regular and periodic circulation through fan-coils avoids stagnation of the domestic hot water supply.

In one broad aspect, method and apparatus for the distribution of water in a high rise building is provided, this building having multiple serviced floors each floor having one or more suites serviced with domestic hot and cold water. Such as method comprises: providing a domestic cold water riser, a domestic hot water supply riser; providing a domestic cold water supply main extending from the cold water riser at each serviced floor for servicing the suites and a domestic hot water supply main at each serviced floor for servicing the suites; reducing the pressure of the domestic cold water supply main for each floor at which the cold water pressure in the cold water riser is above a first pressure threshold; and reducing the pressure of the domestic hot water supply main prior to domestic use fixtures of each suite at each floor at which the domestic hot water pressure in the domestic hot water riser is above a second pressure threshold.

Preferably, the method further comprises extending the domestic hot water supply main from the hot water supply riser to a domestic hot water return riser and reducing the pressure of the hot water between the hot water supply main and the domestic use fixtures.

Preferably, the first and second pressure thresholds are about domestic plumbing fixture pressures and the hot water supply main is maintained hot by circulating hot water from the hot water supply main to the domestic hot water return riser, such as through a bleed valve.

More preferably, when applied with fan-coils having a heating circuit, full pressure domestic hot water from the hot water riser is supplied to the fan-coils and returns to the domestic hot water return riser. A plurality of individual and pressure reduced hot water lines branch off of the hot water distribution main to extend to ach of the domestic fixtures. Temperature control valves on the fan-coils can be periodically opened for a brief period to ensure that no stagnation takes place in the fan-coil, particularly in hot weather conditions when there is no call for heating.

DETAILED DESCRIPTION OF THE PREFERRED EMBODIMENT

Figure 1A:
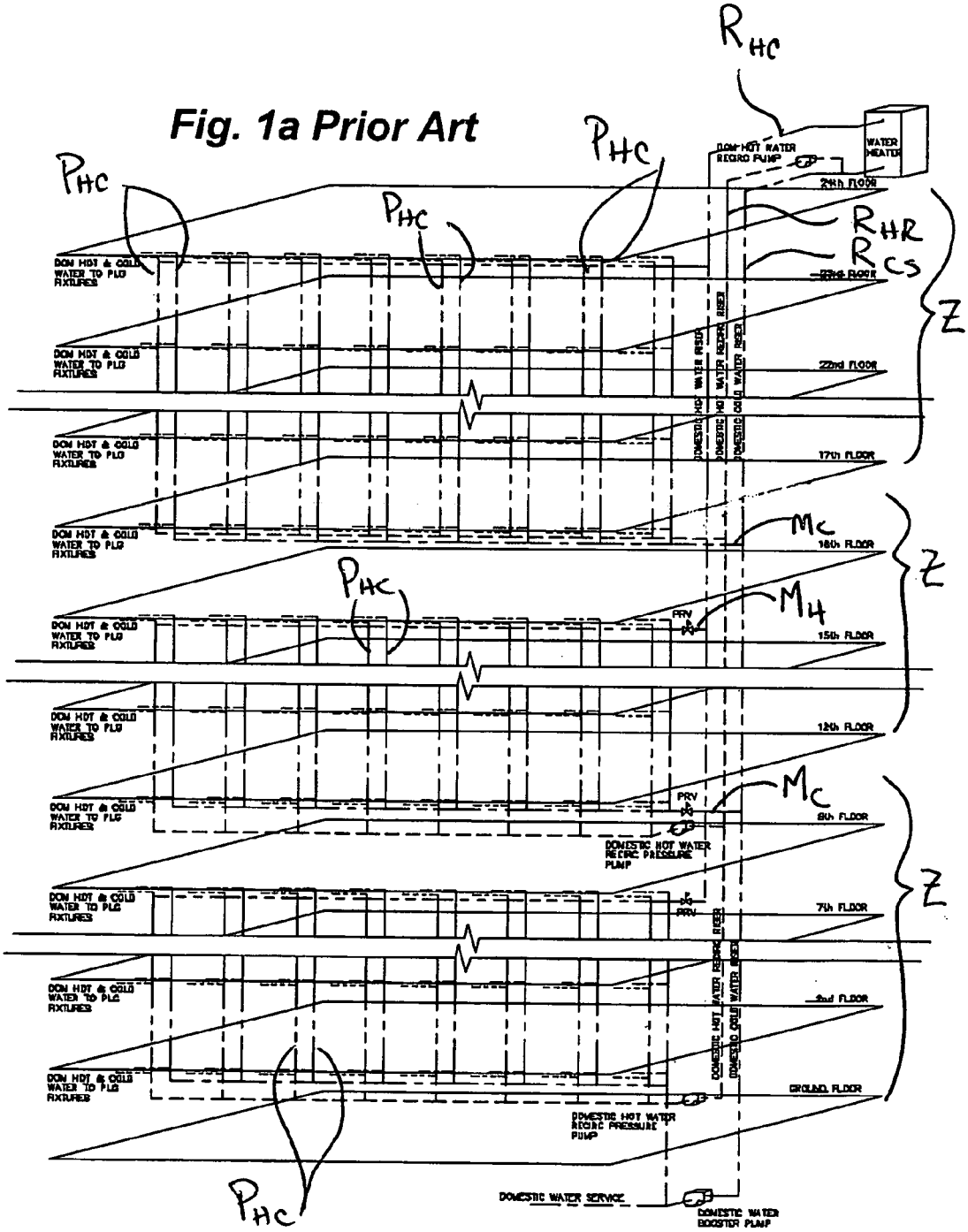
Fig. 1a Prior Art
FIG. 1*a* is a schematic isometric view of a prior art water piping system of a conventional 24 floor high rise building.
Figure 1B:
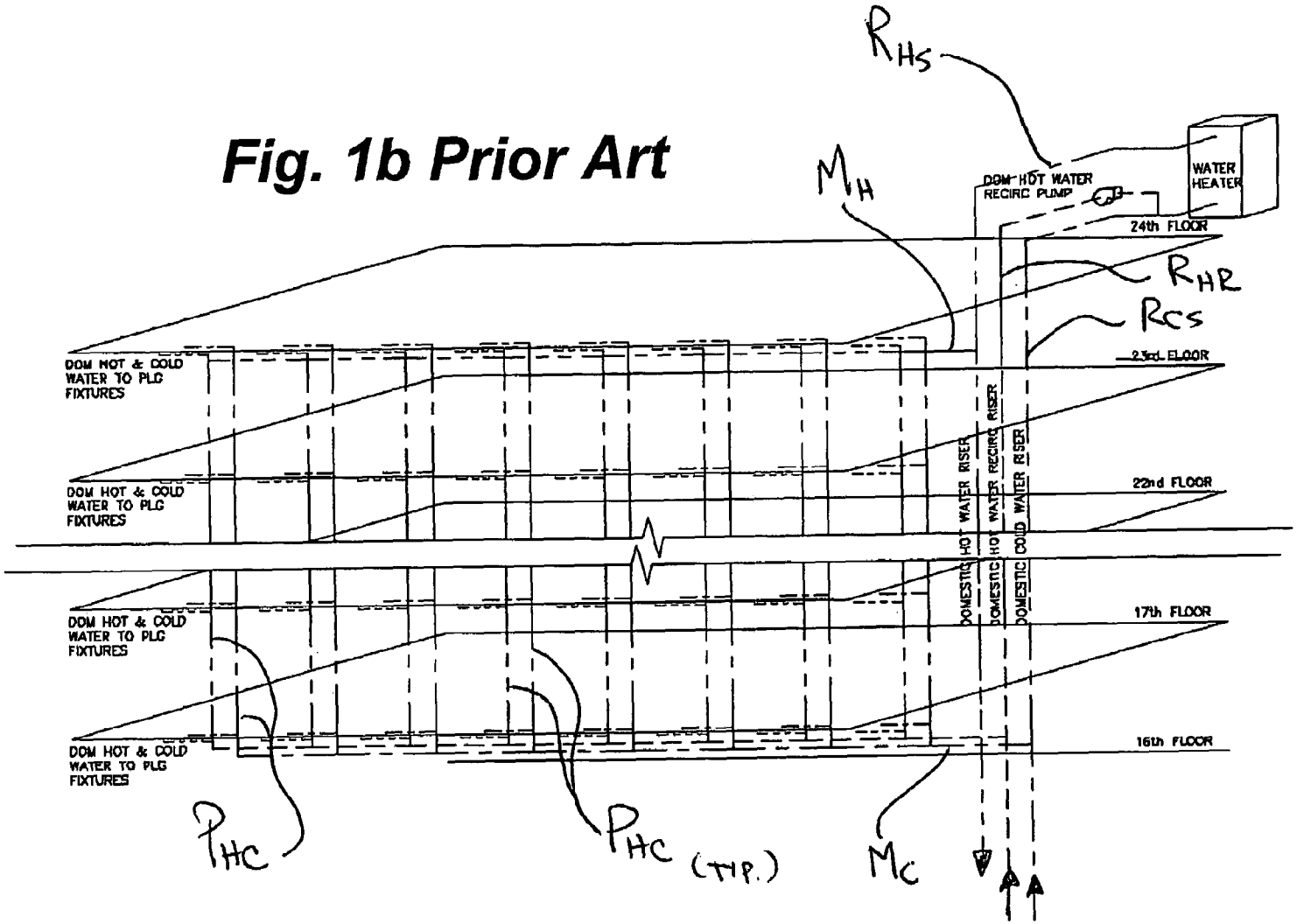
Fig. 1b Prior Art
FIG. 1*b* is a close up view of the upper floors of the prior art schematic isometric view according to FIG. 1*a;*

As shown in FIGS. 1*a* and 1*b*, conventional prior art systems for distribution of domestic water in a high rise comprise vertical zones Z of 8-10 floors, each zone having only one horizontally extending supply run or distribution main $M_H$ for domestic hot water and one main $M_C$ for domestic cold water. From these cold and hot mains $M_C$,$M_H$, sets of water distribution risers extend vertically up or down for distribution to each floor in the vertical zone Z. In particular, pairs of a hot and cold risers $P_{HC}$ are provided for each horizontally arranged suite, each pair $P_{HC}$ subsequently extending vertically to similarly situated suites arranged one above another on each floor in the zone Z.

As a result, the prior art distribution system for a building having a typical eight suites per floor can have eight pairs $P_{HC}$ of risers (16 risers) extending up through each floor in a zone, in addition to a main cold water supply riser $R_{CS}$, a hot water supply riser $R_{HS}$ and a hot water recirculation or return riser $R_{HR}$ aided by a domestic hot water recirculation pump. Water pressure variation between the lowermost and the uppermost floors is about 30-40 psig.

Figure 2:
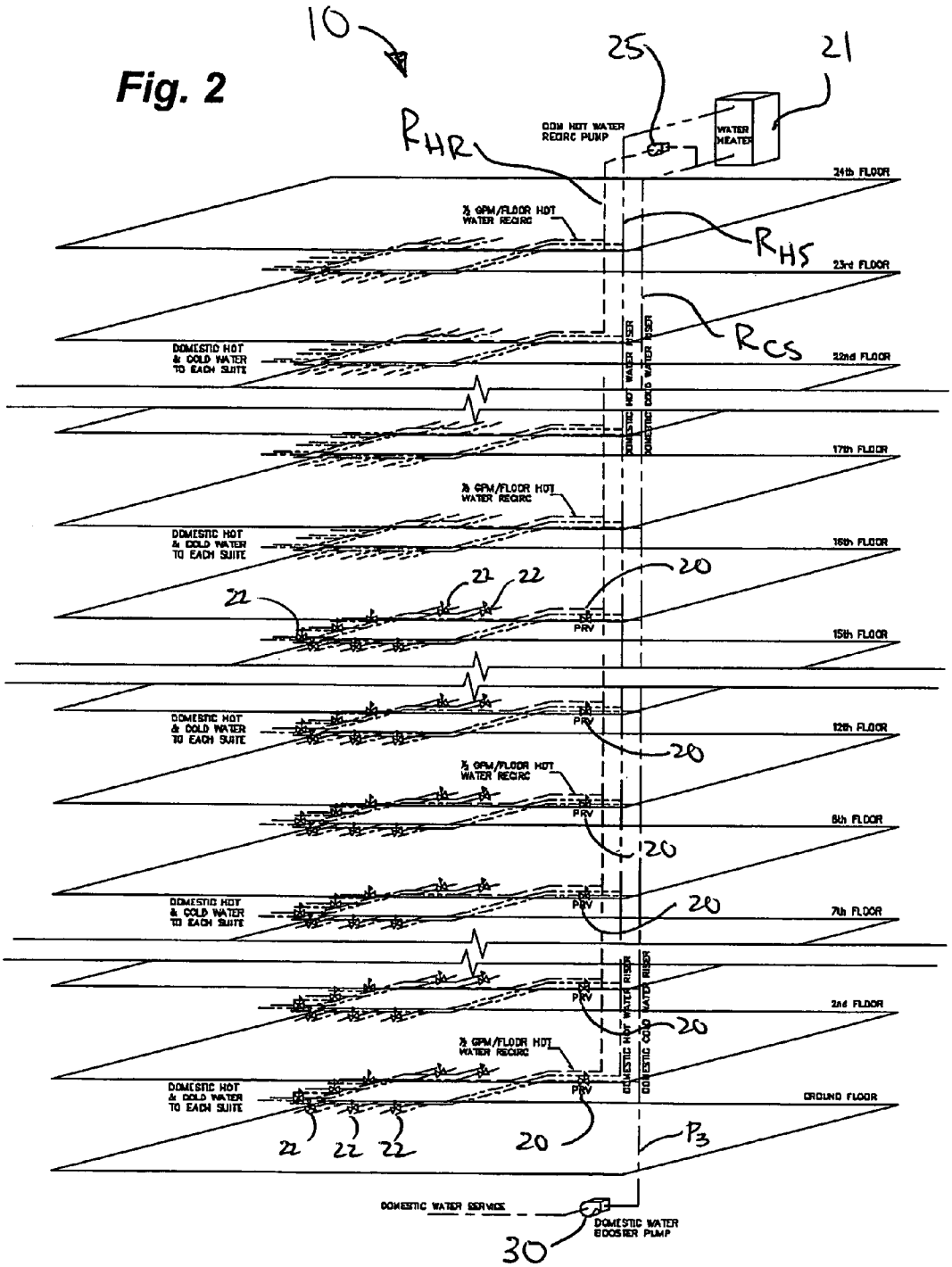
FIG. 2 is a schematic isometric view of a water piping system of one embodiment of the invention illustrating minimizing the number of vertical risers necessary for the same conventional high rise building of FIG. 1.

With reference to FIG. 2, improved efficiencies and comfort can be achieved using an improved piping system according to a first embodiment. Piping savings are realized by replacing the prior art system of 8 pairs $P_{HC}$ of in-suite hot and cold risers. In contradistinction to the multitude of in-suite risers required in the prior art system, one embodiment of the invention for domestic water distribution is shown having only cold and hot supply risers $R_{CS}$,$R_{HS}$, and a domestic hot water return riser $R_{HR}$ extending vertically up the building.

Figure 3:
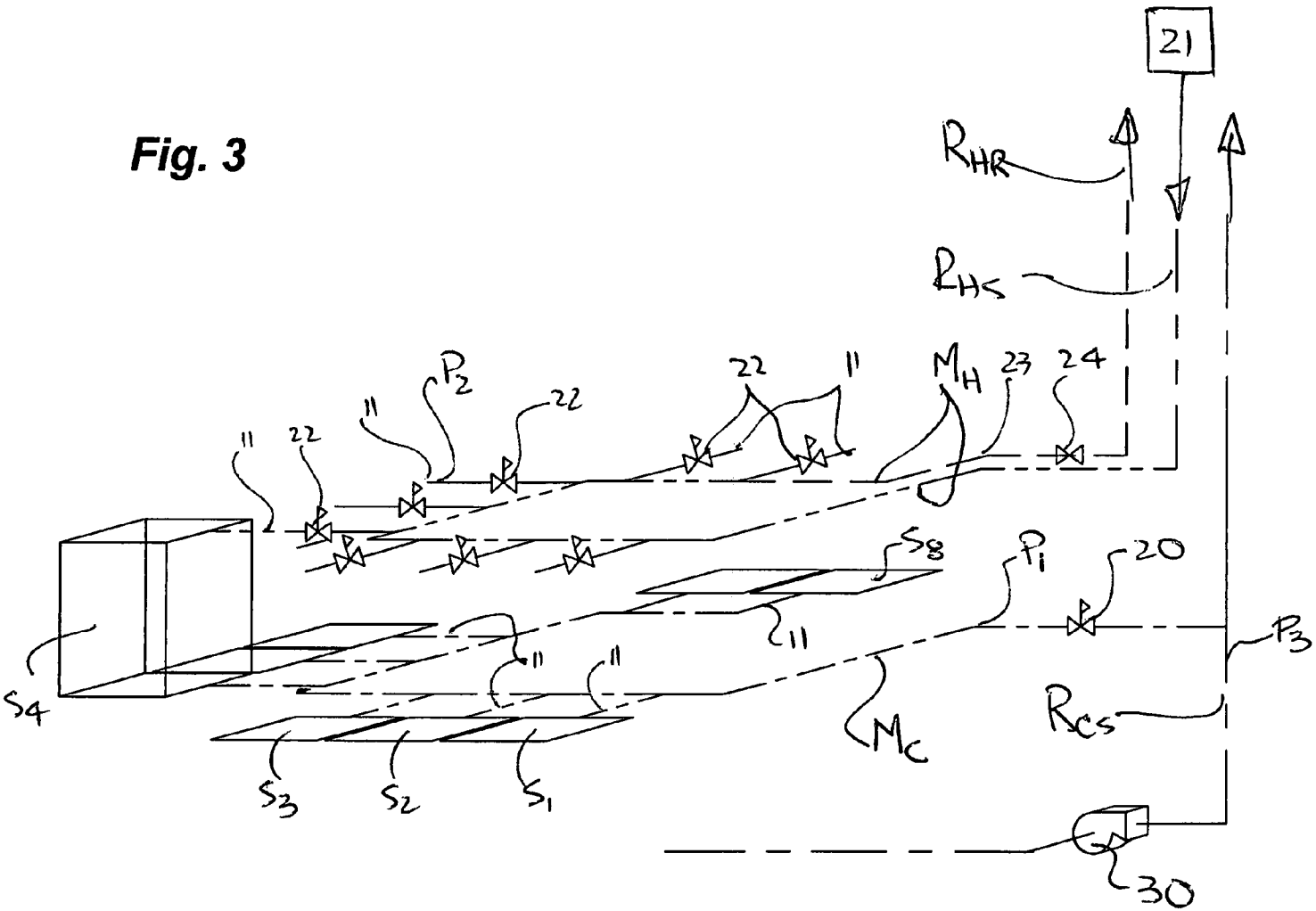
FIG. 3 is a close up of one base floor of the system of FIG. 2 with the cold water and hot water runs spaced for viewing clarity.

With reference to FIG. 3, and as shown in greater detail, each floor is supplied with domestic cold water and domestic hot water supply mains $M_C$,$M_H$ for providing domestic cold and hot water service to domestic use fixtures of facilities 11.

Domestic cold water in the supply main $M_C$ is provided for use with facilities 11 at each suite at conventional pressures at or less than a first pressure threshold $P_1$. Typically the maximum of this first threshold $P_1$ is about 80 to 85 psig. Similarly, hot water for domestic use with facilities 11 is also provided at a second pressure threshold $P_2$ which is typically and substantially the same as the first threshold $P_1$.

In order to provide water under sufficient pressure to more than one vertically arranged floor in a building, each successive higher floor experiencing a loss of hydraulic head, the cold water supply riser $R_{CS}$ is pressurized to a third pressure threshold $P_3$ which is higher than the desired domestic pressure so that a minimum domestic pressure is maintained, even at the highest floors. The hot water supply riser $R_{HS}$ which is typically connected to the cold water supply riser $R_{CS}$ through a hot water heater 21, also extends either up or down the building, is subject to the same hydrostatic head and will operate at substantially the same pressures. Accordingly, a lowest floor in a zone Z is supplied at the greatest pressure with pressure diminishing to a highest floor which is supplied at the lowest pressure.

The pressure $P_1$, $P_2$ of water for domestic cold and hot water use at facilities 11 in the suites is controlled between the respective cold and hot water risers $R_{CS}$, $R_{HS}$ and the domestic use facilities 11 including plumbing fixtures such as sinks, washing facilities and toilets. Hydrostatic head is managed using pressure reducing valves (PRV) 20 or 22, the location of which is particular to the water supply; more particularly whether it is domestic cold or hot water. Typically, the domestic hot water system has a recirculation requirement to enable movement into the domestic hot water return riser $R_{HR}$ and to maintain hot water temperatures with dynamic refreshing with hot water circulation. The top floor and upper floors may have pressures at, or less than, the first and second pressure thresholds $P_1$,$P_2$, and thus do not require further pressure reduction through the use of PRVs.

However, lower floors having pressures greater than the respective thresholds will require pressure reduction. For such floors, one cold water PRV 20 is provided between the domestic cold water riser $R_{CS}$ and the horizontal main $M_C$ affecting all cold water lines branching off therefrom. Therefore, the pressure to the facilities 11 for all suites is controlled by the lone cold water PRV 20. Upper floors, under less hydraulic head will already have acceptable domestic pressures and accordingly, cold water PRV's can be omitted for horizontal mains $M_C$ for the upper eight or so floors which are at the lowest pressures.

Hot water recirculation between the hot water heater 21 or boiler 21*b*, the risers $R_{HS}$,$R_{HR}$, and for each distribution main $M_H$, is maintained at full hydrostatic pressures so as to enable recirculation of return hot water through the return riser $R_{HR}$ and to the hot water heater 21. A single PRV cannot be employed on the hot water main $M_H$ or else flow into the higher pressure return riser $R_{HR}$ is not possible. Therefore, on each floor, a plurality of hot water PRVs 22 are provided, one at each suite. Each PRV reduces the pressure between the full pressure of the hot water main $M_H$ and the actual domestic use facilities 11 at domestic service pressures. Again, hot water PRV's 22 can be omitted for the upper floors which are at the lowest pressures.

The recirculation of the hot water system comprises the distribution main MH extending, from the hot water riser $R_{HS}$, to each suite $S_1$-$S_8$ in series and including a return line 23 after the plumbing stub off of the last suite $S_8$, and a flow control valve or bleed valve 24 between the return line 23 and the domestic hot water return riser $R_{HR}$.

The bleed valve 24 enables circulation of a small and minimum continual flow of hot water (for example about ½ gpm) to maintain the temperature of the hot water adjacent each facility's taps. Such a system is described in greater detail below.

Alternatively, in another embodiment, such as in warmer environments where fan-coil heaters are not employed, one can eliminate the domestic hot water return riser $R_{HR}$ and instead apply electrical heat tracing to the hot water distribution mains on each floor. This also eliminates the need for recirculation of a small flow through a bleed valve 24. In such as case, the domestic hot water supply main $M_H$ can be configured the same as the cold water supply main $M_C$, wherein a single PRV is applied to reduce the pressure of the entire main.

In very tall high rise buildings, the hydrostatic head can be significant. To accommodate lower and conventional pressure limits on water distribution systems such as fan-coil environmental controls and hot water heaters, it is convenient to use elevational, multi-zonal systems to limit the third pressure threshold $P_3$ applied at each zone Z.

Figure 4:
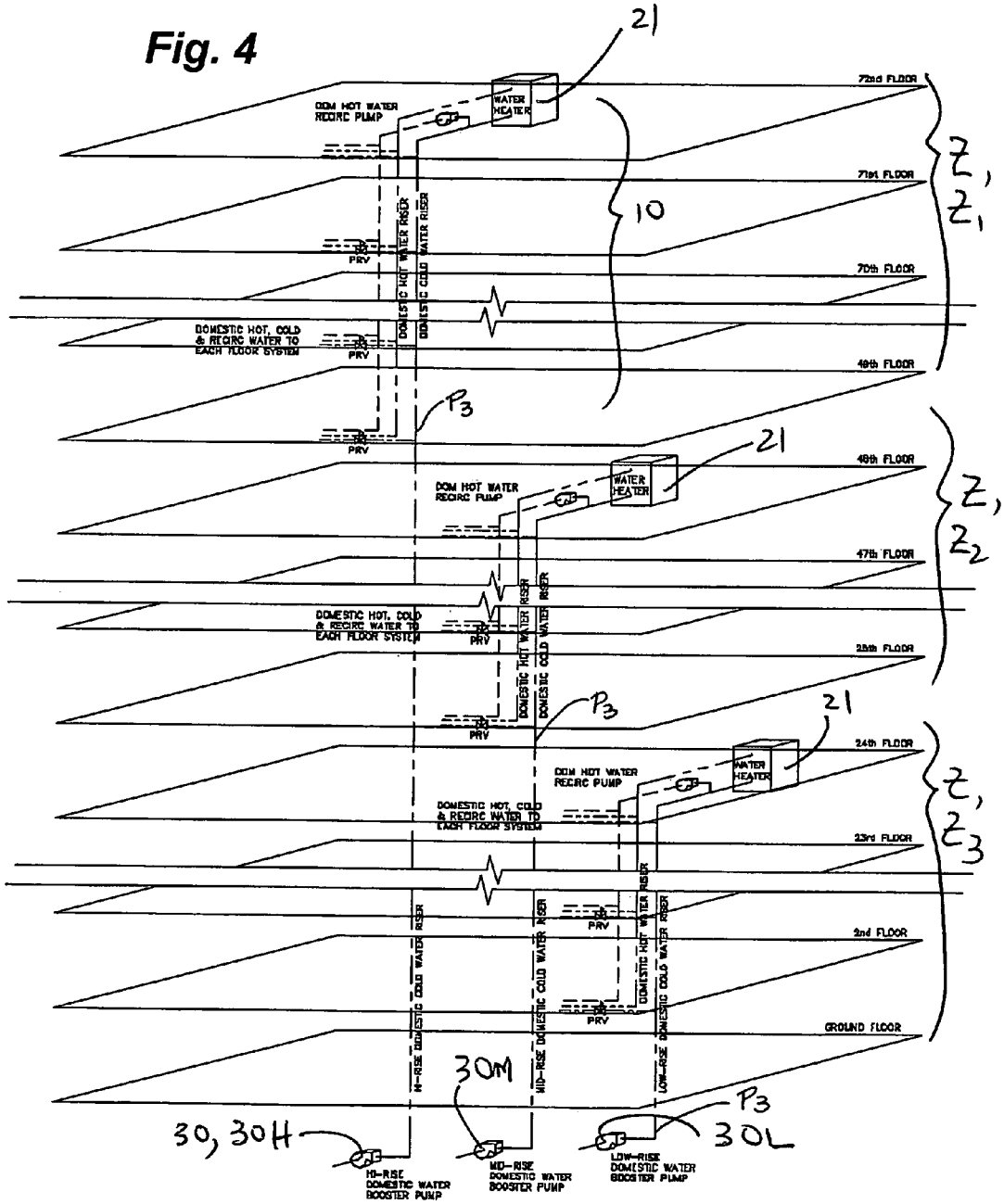
FIG. 4 is a schematic isometric view of a water piping system of another embodiment of the invention illustrating application of the system of FIG. 2 to a 72 floor high rise building of FIG. 1 and FIG. 2.

With reference to FIG. 4, multiple systems of the 24 floor system illustrated and set forth in FIG. 2 are applied as needed such as illustrated in the case of a 72 story building having three zones Z,Z,Z, or identified as Z1,Z2,Z3. Each of the three zones Z,Z,Z of about 24 floors each are fit with a domestic water booster supply pump 30. In low rise buildings, sometimes the municipal supply pressure is sufficient for about eight floors or so, however for high floors, a booster pump is required.

The booster pump 30 supplies water pressure to the cold water riser $R_{CS}$ and to the hot water recirculation system $R_{HS}$,$R_{HR}$. The booster pump 30 supplies the lowest floor of each zonal system at a third pressure threshold $P_3$ of about 125-140 psi. The pressure control of water to domestic facilities 11 is required for about 16 or so of the 24 floors, the upper eight or so floors being substantially at or less than the first and second threshold pressures $P_1$,$P_2$. For example, the booster pump 30 for each zone of 1-24 floors supplies the ground or lowest floor at about 120 psi with the top floor (e.g. $24^{th}$ floor) of each zone being supplied at diminished hydrostatic head at a minimum of about 40 psi. A low rise booster pump 30,30L supplies the lower zone, a mid-rise booster pump 30,30M supplies the middle zone and a high rise booster pump 30,30H supplies the top zone.

The hot water heat exchanger, boiler 21*b*, or heater 21 used in the domestic hot water system is conveniently placed at each upper floor of each zone Z (e.g. the $48^{th}$ floor, $72^{nd}$ floor, . . . ). Accordingly, the water booster pumps 30L,30M, 30H also supply each hot water heater 21 with makeup water at the minimum pressure for the zone Z.

Similarly, the mid-rise water booster pump 30M for floors 25-48 will supply the $25^{th}$ floor at about 125-140 psig and supply the water heater 21 at the $48^{th}$ floor at a minimum of 40 psig. The high-rise water booster pump 30H for floors 49-72 will supply the $49^{th}$ floor at about 125-140 psig and supply the water heater 21 at the $72^{nd}$ floor at a minimum of 40 psig.

In each zone of 24 floors, each of the about 16 lower elevation yet higher pressure floors are fit with a PRVs 20 for the cold water main $M_C$ and PRVs 22 are applied before each suite from the full pressure hot water main $M_H$.

In another embodiment, some additional efficiencies are realized when plumbing for heating and cooling fan-coils 40, typically provided one per suite, are tied into the sprinkler and domestic systems. This is achieved by adapting a system in which the chilled-water supply and return risers are part of a combined chilled-water and sprinkler system. An example of such a system is set forth in U.S. Pat. No. 5,183,102 to Clark, the entirety of which is incorporated herein by reference. Economies are achieved where one need not plumb new or independent risers for independent chilled and independent heated water for fan-coils where chilled water can be provided through existing sprinkler risers and heated water can be provided from domestic hot water supply risers. The system of Clark can be used to satisfy sprinkler needs, domestic hot water purposes and fan-coil supply.

Figure 5:
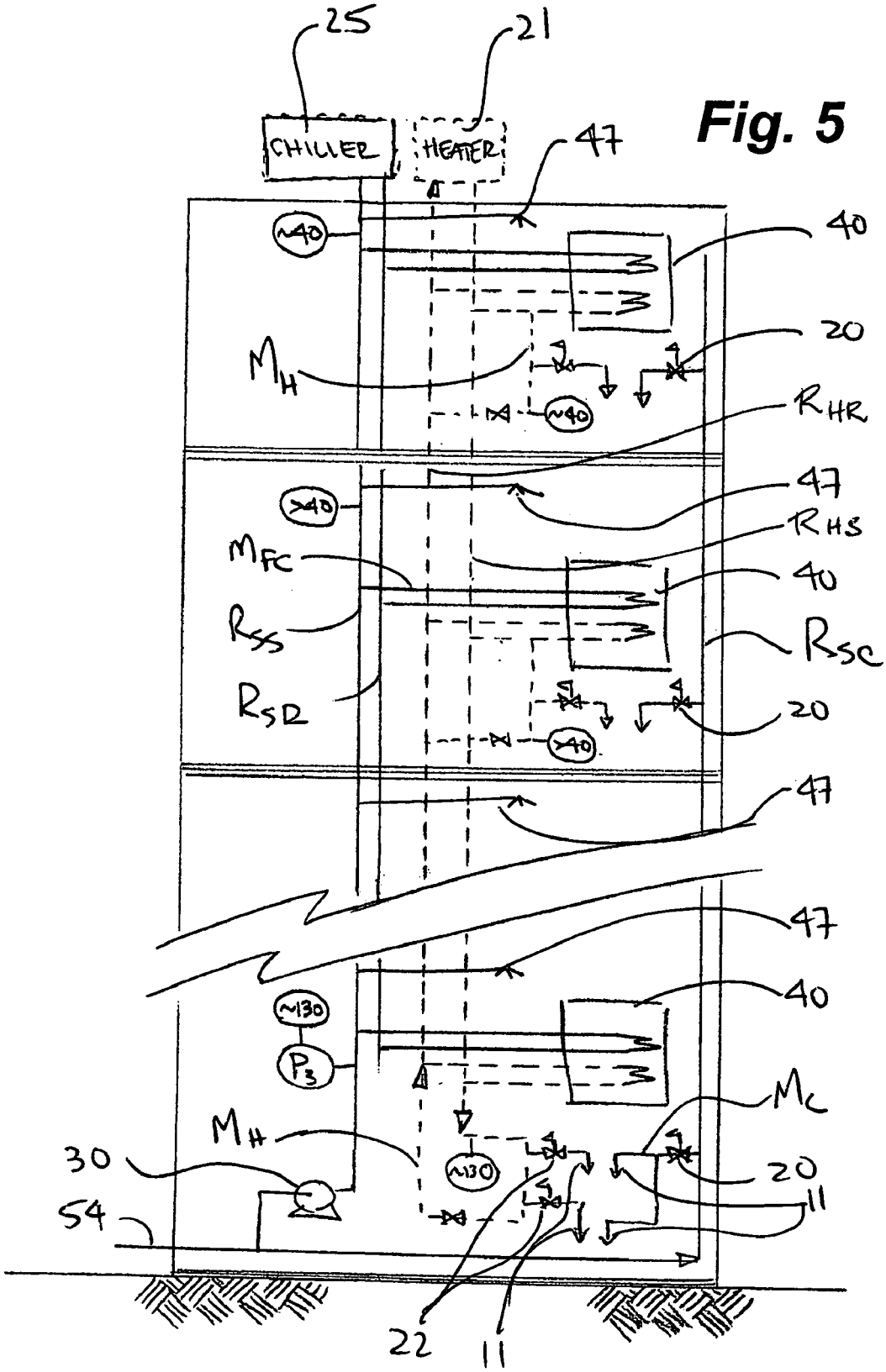
FIG. 5 is a schematic elevation of a high rise building implementing some of the features of the present invention.

With reference to FIG. 5, fan-coils 40 can be tied into both a chilled water sprinkler $R_{SS}$ riser, such as a standalone chilled water system or as part of the multipurpose chilled sprinkler system of Clark, and into a heated water riser $R_{HS}$ which can include a domestic hot water system. The fan-coils 40 can operate at the third pressure threshold $P_3$ or full pressure available from the risers for each zone Z. Therefore, additional piping is not required for the system of fan-coils 40 separate from the pre-existing sprinkler and domestic hot water systems.

Figure 6:
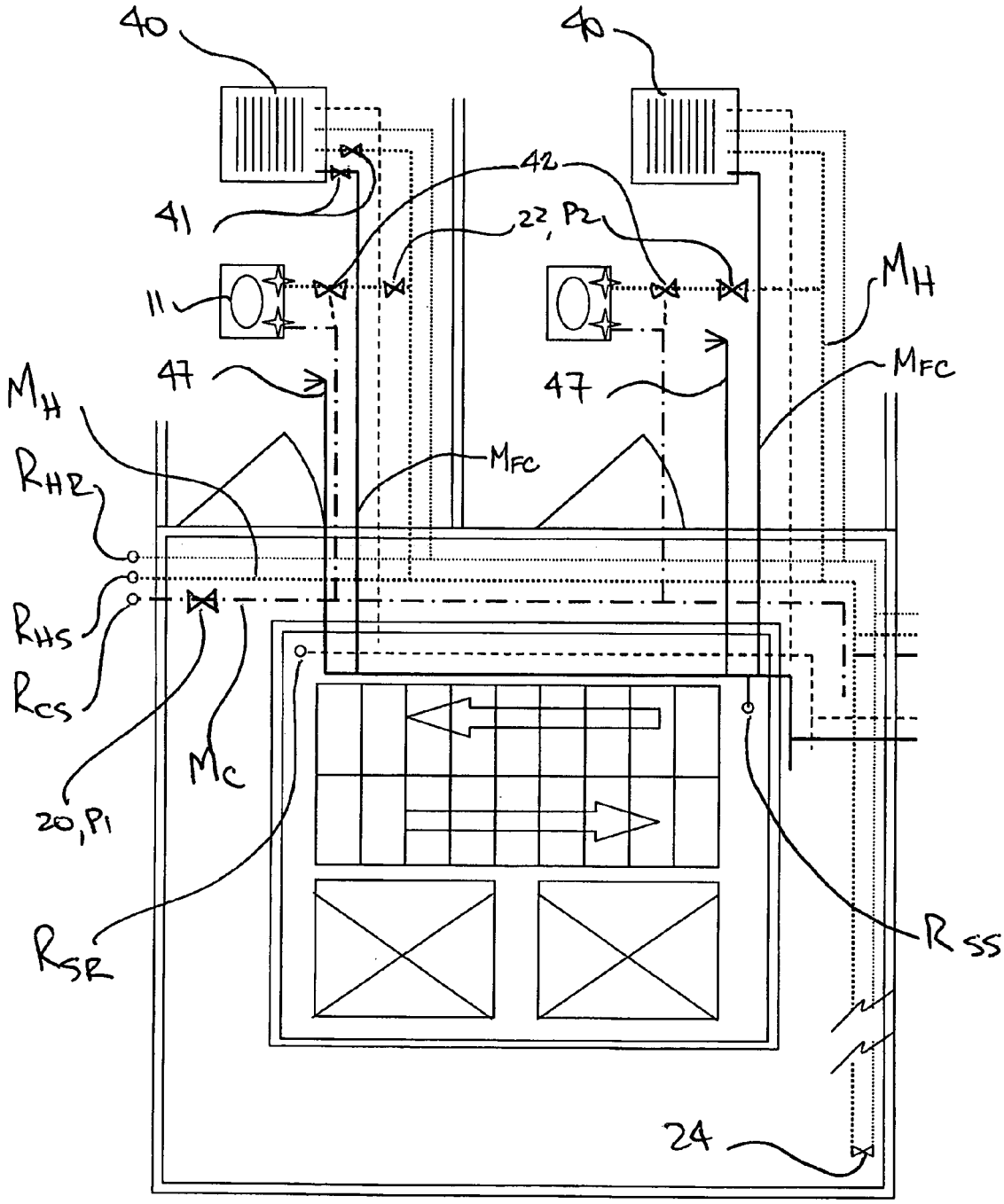
FIG. 6 is a schematic plan view of 2 suites in detail of a typical 8 suite, residential unit layout of a floor of a high rise building.

As shown in FIGS. 5 and 6, a typical floor of a multi-story building, having 8 suites per floor, includes a fire sprinkler piping system comprising at least one chilled-water supply standpipe or riser $R_{SS}$, a chilled-water return standpipe or riser $R_{SR}$, a plurality of chilled-water supply and return mains $M_{FC}$ to each fan-coil 40. Chillers 25 and heaters 21 (typically boilers) may be situated below or atop the building.

A domestic cold water riser $R_{CS}$ supplies the cold water main $M_C$ for distribution of cold water to the domestic facilities 11 including plumbing fixtures in the suites, which are pressure reduced to domestic use pressures at a PRV 20, positioned between the riser $R_{CS}$ and the supply main $M_C$ which is piped to each of the suites.

The domestic hot-water piping system distributes hot water to various portions of the building and the plumbing fixtures 11 in the suites and includes the hot-water supply riser $R_{HS}$, the hot-water return riser $R_{HR}$, hot water supply mains $M_H$ one for each floor, and a plurality of PRV's 22 off of each main $M_H$ to supply pressure-reduced hot water to each of the suites including a plurality of hot-water distribution lines as outflow points such as faucets in a bathroom or in a kitchen area.

A plurality of fan-coil units 40 are located throughout the building and more particularly in each suite. Each fan-coil unit includes a hot-water circuit and a chilled-water circuit that can access water circulating in the domestic hot-water piping system and chilled water system, respectively. Each fan-coil can selectively access hot water or chilled water to meet the heating and cooling demand. Air circulated over a hot or a chilled coil provides heating or cooling ability.

With reference to FIG. 6, in a fan-coil embodiment illustrated herein in greater detail, a 2" chilled water distribution main $M_{FC}$ is provided extending off of a chilled water 6" riser $R_{SS}$ of a sprinkler system. Chilled water sprinkler lines 47 are insulated so as to prevent condensation. An additional sprinkler riser $R_{SR}$ in the stairwell with floor distribution on all floors is utilized as the return system from all fan-coils 40. The sprinkler supply riser $R_{SS}$ in a second stairwell is utilized as supply for all fan-coils 40. Actual fire sprinkler distribution to sprinkler lines 47 is typical to each of the eight suites on a floor.

Chilled water is provided to the fan-coils 40 at full sprinkler riser supply and return pressures. A sprinkler jockey pump in conjunction with a booster pump 30, as required, provides enough pressure at the ground floor to maintain a minimum pressure at the top floor. The minimum pressure is typically at least about 40 psig and in some jurisdictions can be as high as about 100 psig.

The fan-coils 40 are also provided with fully open/close or modulating control valves 41 with automatic changeover thermostats.

Individual pressure reducing valves PRV's 22 are provided off of the hot water lines to each fan-coil 40, at each suite, to retain full hot water riser pressure to the fan-coils 40 so that water pressure ensures return to the domestic water boilers 21*b* while lower pressures are available at the facilities 11 as required. Riser pressure at a fan-coil 40 cannot be reduced or else such pressure-reduced hot water could not return to the return riser $R_{HR}$ and recirculate to the hot water heaters 21 or boilers 21*b*.

The first pressure threshold $P_1$ at the cold water distribution main $M_C$ is reduced to about 60 psig which is also about the second pressure threshold $P_2$ for the hot water distribution lines in each suite. A mixing valve 42, if required, reduces the water temperature as required for residential use. The hot water supply, depending on design of the system, may be anywhere from 170° F. to 140° and can be reduced in temperature to the 110° F.-140° F. range as required. The pressure-reduced hot water is distributed to the plumbing fixtures 11 in the suites. The pressure reduced cold water for the floor and the pressure reduced domestic hot water at each suite can be metered at each suite, if required.

The cold water PRV 20 is provided for reducing the pressure of the cold water distribution to all suites on the floor and individual cold water branches are directed to plumbing fixtures 11 and to the mixing valves 42 as necessary to reduce the maximum hot water temperature for domestic use. The sprinkler supply riser $R_{SS}$, return riser $R_{SR}$ and sprinkler lines 47 are not pressure reduced.

At the end of the hot water main $M_H$ or supply loop after having supplied all suites, it is preferable to install a flow control valve 24 set at about ½ gpm to assure that there is a continual flow and supply of hot water in the distribution main on each floor and adjacent each suite. This is important especially in the summer months when no hot water is flowing through the coils. More preferably, in the case of very large residential suites, the flow control valve 24 can be located in each suite to assure that the hot water reaches the suite's faucets in less time.

This general distribution system is also utilized in most of the upper floors of a high rise building, however, once the pressure in the cold and hot water reduces to approximately 80-85 psig or less, PRV's 22,20 on both hot and cold water respectively are no longer required.

This distribution system can also be adapted to distribute to two adjacent floors at once. For example, if one runs re-circulating and sprinkler/chilled water supply in the ceiling it may be used to feed both adjacent floors above and below. For example in the case of a four-story building, the cold water and hot water distribution mains $M_C$,$M_H$ may only be in the ceiling of the first and third floors.

In some buildings there are three or more sprinkler standpipes $R_{SS}$,$R_{SR}$ due to distances and code requirements, and it may be most economical to let all sprinkler standpipes or risers $R_{SS}$,$R_{SR}$ serve as return lines or risers $R_{SR}$ for the chilled water and run a dedicated riser for chilled water supply (not shown). This may also be done on some buildings which require more than one fire zone per floor.

Figure 7:
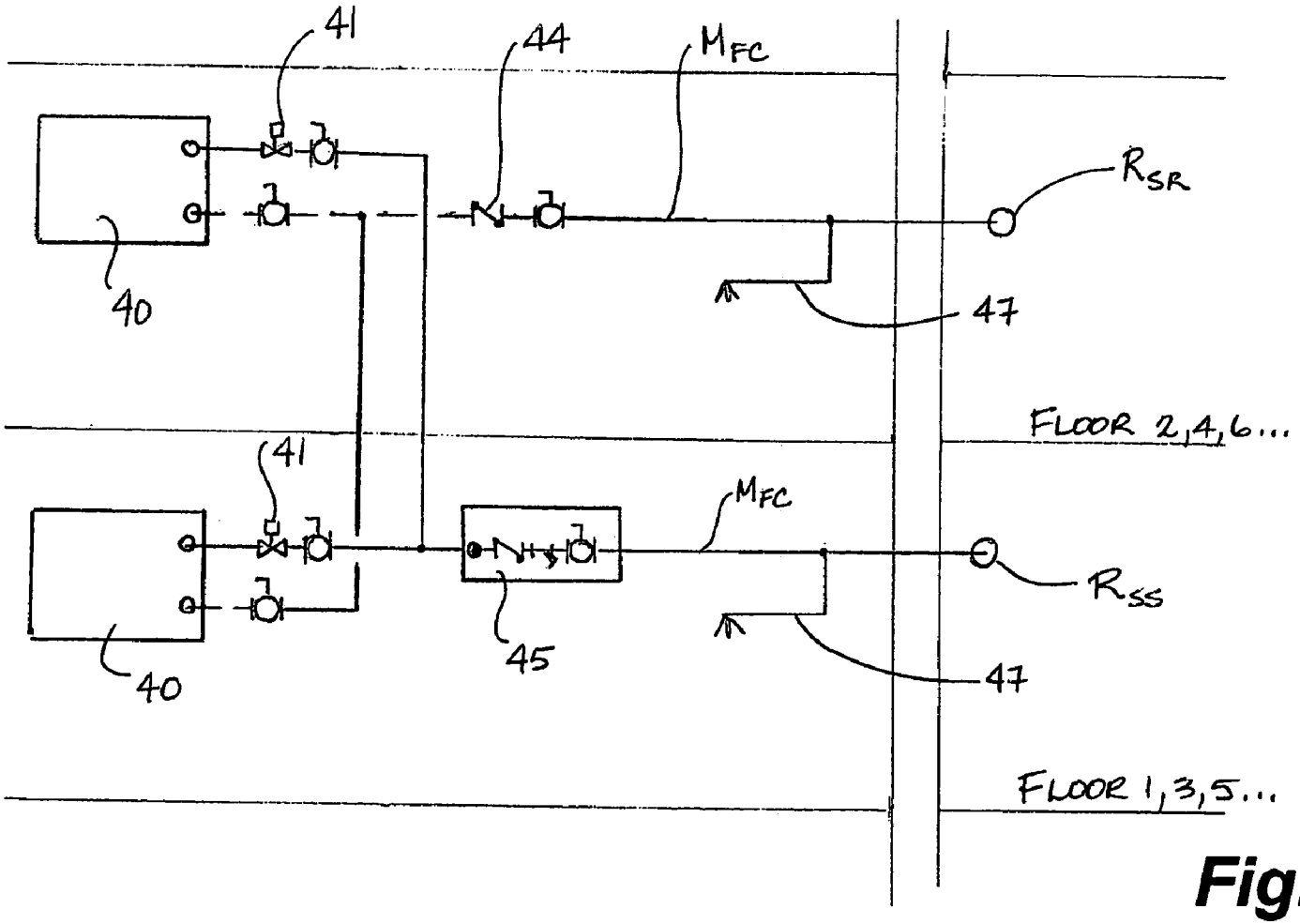
FIG. 7 is an alternative sprinkler/chilled water arrangement for typical floors.

With reference to FIG. 7, one other option to the distribution system is to have the sprinkler standpipe $R_{SS}$ on one stairwell serve as a supply and distribute chilled water through every other floor 1, 3, 5, 7 . . . etc. This would mean that chilled water take-off to fan-coils 40 on the first floor would also feed up to the fan-coil in the suite directly above on the second floor. Then, on floors 2, 4, 6, 8 etc. the sprinkler distribution $R_{SR}$ would come off the return main, which could be a sprinkler standpipe in the other stairwell. This would then return the chilled water from the fan-coil on the second floor and drop down in each suite to pick up the return for the fan-coils on the main floor. As illustrated, horizontal sprinkler mains $M_{FC}$ supply fire sprinkler lines 47 in suites. Autocheck valve assemblies 45 and a swing check valve 44 may be required by the local fire authority. Shut-off valves are typically employed to isolate the cooling coil section of a heat/cool fan-coil 40.

In another embodiment, the automatic changeover thermostat 41 is only enabled with a temperature setting. The fan-coils 40, to ensure quiet running, should operate on medium or low speed and run all the time. This does three things: first, it provides a background white noise from the moment the resident moves in and the resident quickly acclimatizes to the noise and does not notice it compared with a fan cycling on and off. Secondly, constant circulation balances the temperature throughout the residence. Lastly, such control is simple and avoids the problems associated with enabling a resident to adjust each of fan speed, fan on/off, or the ability to manually changeover from heat to cool. A simple system is typically the best system.

The heat transfer elements of fan-coils 40 are manufactured of copper or other material which is appropriate for potable water. They are typically tested for a minimum of 250 psig, to will safeguard the system for tall buildings where both sprinkler lines and domestic water lines at the lower floors are at relatively high pressures.

Preferably, the control valve 41 on the hot supply to the fan-coil 40, which has been conventionally operated on temperature control only, is now preferably and additionally fitted with a timer device which periodically opens the valve for 30 seconds or so of flow each day to assure that no stagnation takes place in the summer months when the heating does not come on. In more detail, the control valve 6 can be an automatic changeover (from heat to cool) and controls two control valves which are either 100% open or closed as one type, as well as an automatic changeover thermostat which modulates one or both control valves as another type.

This assures that the domestic hot water, which is potable water, does not stagnate in the fan-coils for months on end. The thermostat can be adapted to provide a timer override to open the control valve despite there being no actual call for heat.

Similarly, a heating-only thermostat can dump water from force flows and hot water unit fan-coil heaters on the same basis as above. This thermostat is typically 120V and will both open the control valve and turn on the fan when heat is required and is incorporated with a timer having 30 seconds of dump every 24 hours or so.

In some climates, de-humidification may be needed to prevent mould and other high humidity problems which can occur in buildings. This can be added to the make-up air system to the building.

With reference to the heating piping schematic of FIG. 7, two pumps 51,51 are arranged on the domestic hot water return line or riser $R_{HR}$ from the building and are operated by a variable frequency drive (VFD) 52 which takes its signal from pressure gauge 53 before the pumps 51,51. As hot water is drawn off for domestic use it needs to be replaced by the cold water supply 54. As the heated water flows into fan-coils 40, force flows at the building entrances and unit heaters in parkade and storage areas, a pressure drop in the return piping signals the VFD 52 to ramp up the return pump or pumps 51,51 to maintain proper circulation in the system. If one pump 51 will not bring the pressure up to required levels, the second pump 51,51 comes on and ramps up as required. When the heating is not required throughout the building, the only pumping required is the small amount of circulation to recirculate the about ½ gpm through the valve 24 on the end of the hot water supply line 23 on each floor. This VFD system on the hot water is a very efficient pumping system. In the described embodiment, pumps 51,51 do not deadhead as they do on most conventional systems. Thus, a minimum of power is required to circulate the hot water. Preferably the VFD 52 alternates pumps 51/51 on a 24 hour-basis.

Figure 8:
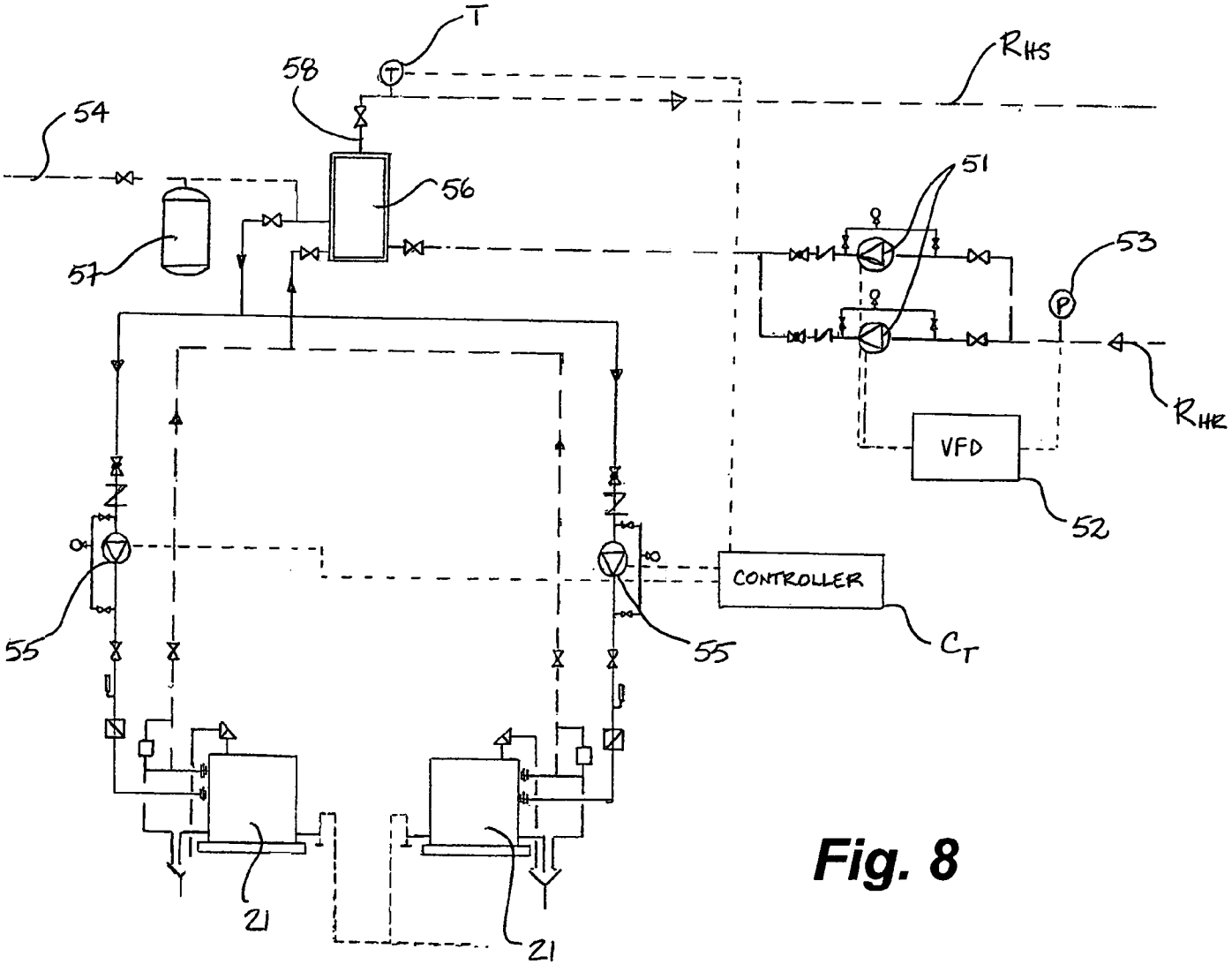
FIG. 8 is a hot water piping schematic.
Figure 9:
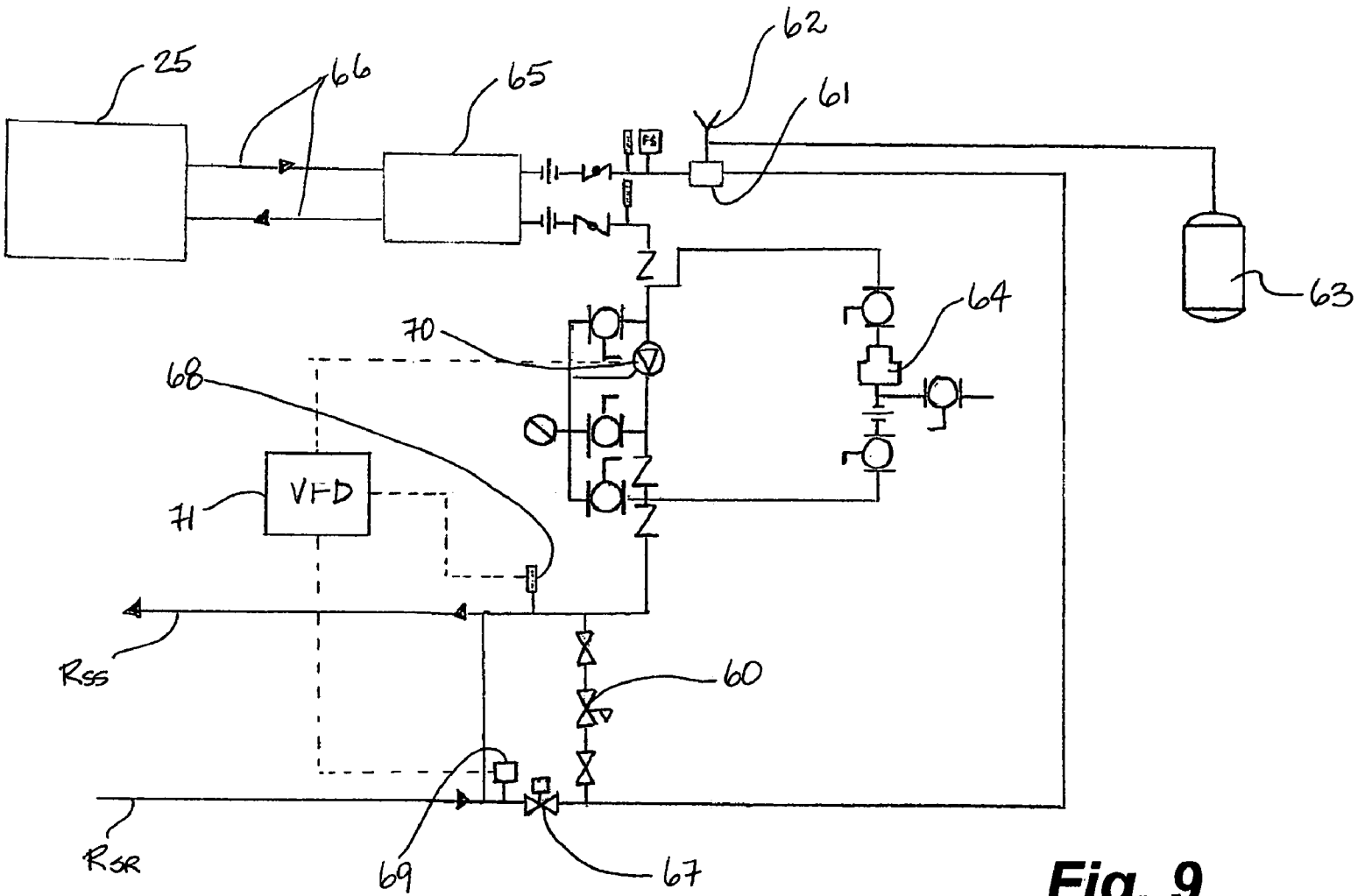
FIG. 9 is a chilled water piping schematic.

Pumps 55 circulate individually through the two separate heaters 21 or boilers 21*b* from a hot water storage tank 56. These pumps 55 and boilers 21*b* are controlled by the discharge temperature T through the use of a Tekmar controller $C_T$ or similar device, which turns one boiler 21*b* on low fire as well as turns on the pump 55 for that boiler. If more heat is required the boiler 21*b* shifts to high fire and if still more heat is required the second boiler 21*b* comes on low fire with actuation of the second pump 55. The system is designed to alternate boilers 21*b* every 24 hours and it can be hooked into a DDC monitoring system, which will indicate if there is any malfunction in any of the above mentioned equipment. The VFD 52 may also be employed to control the flow on the chilled water system as shown in FIG. 8.

The hot water storage tank 56 is usually a custom made glass lined storage tank which has adequately sized tappings so as not to restrict flow. It can be any size in terms of volume to meet the requirements of the building. Two or more tanks can easily be used as well and piped in series appropriate to good engineering principles.

Expansion tank 57 is sized according to good engineering principles. When in use in a tall building, which requires pressure booster system, the expansion tank is sized larger as it serves as a buffer for the pressure system.

Hot water supply 58 connects to the hot water supply riser $R_{HS}$ for the building, which serves both domestic hot water and building heating hot water. The domestic hot water return riser $R_{HR}$ for the building supplies the pumps 51,51. The cold water supply line 54 ties into the hot water heating system.

This fan-coil system can have one to any number of boilers 21*b* and if used concurrently for domestic hot water, these boilers would be domestic water boilers. Two boilers 21*b*,21*b* are shown. This system can work just as well with boilers 21*b* using a different fuel or any other means of heating such as solar, central heat pump, heat off an electrical generator, heat generator from a water-cooled chiller or any other heat source.

The entire hot water piping system is also the domestic water system and is therefore classified as potable water. Accordingly, all piping is specified as copper, plastic, ductile iron or another material, which does not rust or corrode.

With reference to the chilled water schematic of FIG. 8, the chilled water system ties into the sprinkler supply $R_{SS}$ and return risers $R_{SR}$ in the stairwells. The chilled water supply $R_{SS}$ to the sprinkler standpipe riser is in one stairwell. The chilled water-return $R_{SR}$ comes from the sprinkler standpipe riser in the other stairwell. A pressure bypass valve 60 is provided for the chilled water system. An air separator 61 is typical to a chilled water piping system complete with air vent 62. Expansion tank 63 is sized according to good engineering practices. Bypass filter assembly 64 filters the water in the system.

Chiller barrel 65 is located inside a mechanical room so as to eliminate the need for glycol on the chilled water system. This is typical for climates where the outside temperature goes below freezing. In warmer climates, the barrel 65 can be located outside in the chiller package. Refrigerant lines 66 extend from the chiller barrel 65 to the chiller 25 which can be either air-cooled or water cooled. Motorized control valve 67 closes when the fire alarm is activated. This is only required if the local fire marshall requires that it be installed.

Pressure gauge 68 on the supply line to the sprinkler standpipe riser $R_{SS}$ and pressure gauge 69 on the return line $R_{SR}$ from the other sprinkler standpipe riser are sensors for control of the chilled water pump 70.

Variable frequency drive (VFD) 71 operates on the differential pressure (68,69) between the supply and return. This VFD regulates the speed of the chilled water pump 70. This VFD 70 could be combined with the heating VFD 52 in one panel.

The chilled water pump 70 could be part of a two-pump system similar to that described FIG. 7. If this system is located in a predominantly hot climate (e.g. Arizona, USA) it is very important to have two pumps so as to operationally available for cooling if one pump were to break down.

Preferably or alternatively, evaporative condensers or other innovative means can be added to this system to increase the efficiencies of the chiller plant. Central ground source heat pumps can be utilized very effectively with the system as well. The sprinkler alarm panel on this system is programmed to adapt to the fact that water flows through the flow switches on each floor. The logic is as follows: The fire alarm panel is programmed to ignore the flow switch signal from each floor until such time as the main flow switch at the water entry to the fire sprinkler system triggered. When this happens, water is discharging from a sprinkler head or hose station. The panel is programmed to send a signal to immediately shut down the chilled water pump or pumps. This will stop all flow through the chilled water system within a few seconds. After 30 seconds delay, the panel is programmed to indicate flow on all the flow switches. Therefore the fire department can identify at what level the sprinkler system is discharging.

While a preferred embodiment of the invention has been illustrated and described, it will be appreciated that various changes can be made therein without departing from the spirit and scope of the invention. Consequently, within the scope of the appended claims, it is to be understood that the invention can be practiced otherwise than as specifically described herein.

The embodiments of the invention for which an exclusive property or privileges is claimed are defined as follows:

1. A system for the distribution of water in a high rise building having multiple serviced floors each floor having one or more suites serviced with domestic hot and cold water, the system comprising:

a domestic hot water heater;

a domestic hot water riser, fluidly connected to the hot water heater, in which hydrostatic pressure varies with elevation;

a domestic hot water supply main extending from the domestic hot water riser at each serviced floor to each of one or more suites in series for servicing domestic fixtures at the suites;

a domestic hot water return riser for returning the domestic hot water from the domestic hot water supply main to the hot water heater and establishing circulation therethrough;

a return line between a last suite of the one or more suites in series and the domestic hot water return riser, a bleed valve along the return line between the last suite and the domestic hot water return riser for maintaining a minimum continual flow of hot water in the domestic hot water supply main for substantially immediately servicing the domestic fixtures with domestic hot water upon demand; and one or more hot water pressure reducing valves between the domestic hot water supply main and the domestic use fixtures of each of the one or more suites of each floor at which the hydrostatic pressure in the hot water supply main is above a hot water pressure threshold.

2. The system of claim 1 wherein the hot water pressure threshold is at a domestic use fixture pressure.

3. The system of claim 1 wherein at least some of the suites are provided with fan-coils having a chilled water circuit and a heated water circuit, further comprising:

a chilled water riser for supplying chilled water to the fan-coil chilled water circuit;

a chilled water return for receiving chilled water from the fan-coil chilled water circuit;

a heated water riser for supplying heated water at hydrostatic pressure to the fan-coil heated water circuit; and a heated water return for receiving heated water from the fan-coil heated water circuit.

4. The system of claim 3 wherein the heated water riser is the domestic hot water riser; and the heated water return is the domestic hot water return.

5. The system of claim 4 further wherein the domestic heated water riser, the fan-coil heated water circuit and the domestic hot water supply main are at the hydrostatic pressure for circulation to the hot water heater and the one or more hot water pressure reducing valves reduce the hydrostatic pressure between the domestic hot water supply main and the domestic use fixtures to the hot water pressure threshold.

6. The system of claim 3 wherein the chilled water riser is a sprinkler water riser.

7. The system of claim 3 further comprising a flow control valve for controlling circulation through the fan-coil heated water circuit for heating the suites and wherein, during periods when heating of the suite is not required, periodically opening the flow control valve for circulating domestic hot water through the fan-coil heated water circuit for preventing stagnation in the fan-coil heated water circuit.

8. The system of claim 7 wherein the flow control valve is an automatic changeover thermostat.

9. The system of claim 1 further comprising:

a domestic cold water riser in which the pressure varies with elevation;

a domestic cold water supply main extending from the domestic cold water riser at each serviced floor for servicing domestic use fixtures of each suite; and a cold water pressure reducing valve for each serviced floor at which the cold water pressure in the cold water riser is above a cold water pressure threshold, each cold water pressure reducing valve positioned between the domestic cold water riser and the domestic cold water supply main for the floor.

10. The system of claim 9 wherein the multiple serviced floors are arranged in vertical zones, further comprising for each zone:

a booster pump which supplies cold water to the cold water riser to ensure a pressure exists therein which, at a lowest floor of the zone, is at or below a booster pressure threshold.

11. The system of claim 10 wherein the booster pressure threshold is greater than the hot water and cold water pressure thresholds.

12. A method for the distribution of water in a high rise building having multiple serviced floors, each floor having one or more suites serviced with domestic hot and cold water, the method comprising:

providing a domestic hot water supply riser;

providing a domestic hot water return riser in which hydrostatic pressure varies with elevation;

providing a hot water supply main extending from the domestic hot water supply riser at each serviced floor to each of one or more suites in series for servicing domestic fixtures at the suites;

circulating domestic hot water at hydrostatic pressure from the domestic hot water supply main and to the domestic hot water return riser through a return line between a last suite of the one or more suites in series and the domestic hot water return riser, maintaining a minimum continual flow of hot water from the return line to and the domestic hot water return riser for maintaining a minimum continual flow of hot water in the domestic hot water supply main for substantially immediately servicing the domestic fixtures with domestic hot water upon demand; and reducing the pressure of the hot water supply main between the hot water supply main and domestic use fixtures of each suite of the one or more suites for each floor at which the hydrostatic pressure in the hot water supply main is above a hot water pressure threshold.

13. The method of claim 12 further comprising:

providing fan-coils in at least some suites, the fan coils having a chilled water circuit and a heated water circuit and providing a chilled water riser for supplying chilled water to the fan-coil chilled water circuit and a chilled water return for receiving chilled water from the fan-coil chilled water circuit; and circulating heated water from the domestic hot water supply main at hydrostatic pressure to the fan coil heated water circuit and to the domestic hot water return.

14. The method of claim 13 further comprising:

controlling circulation through the fan-coil heated water circuit for heating the suites; and wherein during periods when heating of the suite is not required, periodically circulating domestic hot water through the fan-coil heated water circuit for preventing stagnation in the fan-coil heated water circuit.

15. The method of claim 12 wherein the hot water pressure threshold is at or below a domestic use fixture pressure.

16. The method of claim 12 further comprising:

providing a domestic cold water riser;

providing a cold water supply main extending from the domestic cold water riser; and reducing the pressure of the cold water supply main for each floor at which the cold water pressure in the cold water riser is above a cold water pressure threshold.

17. The method of claim 16 wherein the multiple serviced floors are arranged in vertical zones, further comprising for each zone:

a booster pump which supplies cold water to the cold water riser so that a maximum pressure therein and at a lowest floor of the zone is at or below a booster pressure threshold; and a hot water heater which supplies the hot water riser and receives domestic hot water return riser.

* * * * *